United States Patent [19]

Timan

[11] 4,125,793

[45] Nov. 14, 1978

[54] PHOTOMULTIPLIER WITH DYNODE SUPPORT STRUCTURE

[75] Inventor: Hans Timan, Yonkers, N.Y.

[73] Assignee: DuMont Electron Tubes & Devices Corporation, Clifton, N.J.

[21] Appl. No.: 764,649

[22] Filed: Feb. 1, 1977

[51] Int. Cl.[2] ..... H01J 39/02; H01J 43/18

[52] U.S. Cl. ..... 313/95; 313/165 R

[58] Field of Search ..... 313/105 K, 95

[56] References Cited

U.S. PATENT DOCUMENTS

| | | | |
|---|---|---|---|
| 3,119,037 | 1/1964 | Stanley | 313/95 X |
| 3,885,178 | 5/1975 | Goehner | 313/105 R |
| 3,959,680 | 5/1976 | Morales | 313/95 |

FOREIGN PATENT DOCUMENTS

| | | | |
|---|---|---|---|
| 811,143 | 4/1959 | United Kingdom | 313/105 |

*Primary Examiner*—Robert Segal

*Attorney, Agent, or Firm*—Roland Plottel

[57] ABSTRACT

A photomultiplier tube in which the anode, which is positioned adjacent to the last dynode, is not supported by the side supports which support the dynodes as was done in the prior art, but is supported by the stem. Thus, the anode "floats" with respect to the side supports and with respect to the dynodes which are rigidly attached to the side support. An advantage of this structure is improved electrical properties, e.g., a reduction in dark current, improved signal to noise ratio and reduction in hysteresis. The floating anode is particularly applicable to box and grid type of dynode structures used in small diameter, e.g., one-half and three-fourth inch tubes.

4 Claims, 5 Drawing Figures

PHOTOMULTIPLIER WITH DYNODE SUPPORT STRUCTURE

The invention relates generally to electron tubes, and more particularly to photomultiplier tubes having an improved anode structure.

A photomultiplier tube is an electron tube designed to receive light, and produce an output electrical signal in accordance with the received light. Light falls on the tube, is converted to electrons which are then gathered and amplified in a series of stages (called dynodes), until finally the electrons are collected at an anode.

The dynodes and anode must be closely positioned relative to each other. Heretofore this has often been done by a box and grid-type structure in which the dynodes and anodes are mechanically held in fixed spatial relation by two side supports. Let us consider, for example, a small size tube, e.g., one-half or three-quarter inch in diameter. Because of the small spacing between the components, and the use of the side supports, there develops some leakage current along the side supports and charge patterns. This is true regardless of what type of insulator the side supports are made from, and it is believed is due to alkaline metal, e.g., cesium vapors which condense in the tube on the supports during the manufacture of the tube. This is termed ohmic leakage and is a contributing factor to dark current. [Dark current may be defined as the current that flows in the tube in the absence of such radiation as is normally used to excite the tube. It is usually desirable to keep the anode dark current at as low a value as possible since fluctuations in dark current are a source of noise in the tube. Dark current also puts certain restrictions on the operation of the tube as well as its sensitivity.]

In the present invention the anode is no longer primarily supported by the side supports, but from the stem or other position in the tube. There is a reduction in dark current, as well as reduction of hysteresis, and an improved signal to noise ratio, and linearity.

According to the invention there is provided a photomultiplier tube comprising a photocathode, a plurality of dynodes rigidly supported in fixed spatial relation to one another on a first support member, an anode being located adjacent to at last one of said dynodes, said anode being supported by a second support member which is separate from said first support member.

Figure 1:
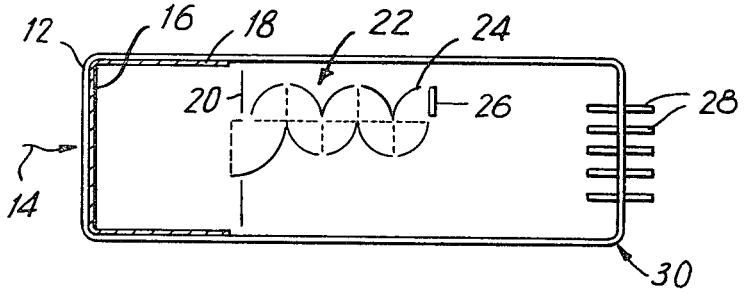
FIG. 1 is a schematic cross section of part of a photomultiplier tube.

Referring now to FIG. 1 there is shown in schematic form a cross section of part of a photomultiplier tube. The tube has a glass envelope 12, light (shown by arrow having legend 14) falls on a light-sensitive photocathode 16 at one end of the envelope and causes it to emit free electrons which are drawn away from the photocathode by an electrode having a more positive potential. [It is understood that potentials are applied to the different elements in the tube. Neither the leads not the potentials are shown in FIG. 1.] These photoelectrons are then focused by various means, e.g., aluminum coating 18 and shield 20 onto the first of several secondary emission stages. Each primary electron striking this stage will free more electrons, which are drawn to the next more positive secondary emission stage. This process is then repeated, each stage having a more positive potential that the previous one. The secondary emission stages are shown with legend 22 and there are shown ten stages or dynodes, the last or 10th one having legend 24. The electrons emitted from dynode 24 are collected at an anode 26 and the amplified current is then passed (by leads, not shown) to pins 28 mounted in the stem 30 of the tube. [It will be appreciated that each of the dynodes are connected by suitable leads to the appropriate pins mounted in the stem of the tube.]

It will also be apparent that because of the electron ballistics required in each of the dynodes, each of them is at a different potential than the previous one and that they must be properly positioned relative one another.

Figure 2:
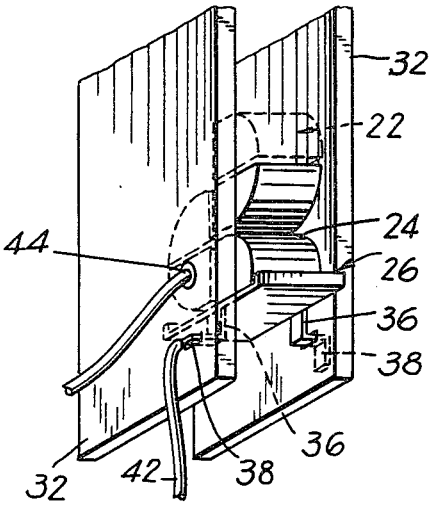
FIG. 2 PRIOR ART
FIG. 2 is a schematic perspective view of part of a prior art tube showing particularly the side supports, the last few dynodes and the anode.

FIG. 2 is a schematic perspective view of part of a prior art tube. Particularly, it shows the last few dynodes (including the last dynode 24) in fixed spatial relationship to the anode 26. The dynodes 22 and the anode 26 are rigidly mounted on two side supports 32 which hold the dynodes and anode in fixed spatial relation. The supports 32, dynodes and anode are in what is sometimes called a box and grid structure, which is attached in a conventional way (not shown) to the inside of the envelope. The anode 26 has a flat bed, two upturned lips, at its front and back, and two side members 36 which protrude (downward, in FIG. 2) and pass through, and are anchored in two apertures 38 in the side supports 32. Thus, the anode is anchored to the side supports. The side members 36 of the anode also provide an electrical conducting path to a lead 42 which for example is welded to one of the side members. Lead 42 is attached at its other end to one of the pins in the stem (not shown) in FIG. 2).

The last dynode 24 is similarly mounted in the side supports, e.g., it has side members which are anchored into the side support. An electrical conductor or lead for dynode 24 is similar to lead 42 but is on the far, and hidden side of the support as shown in FIG. 2. The next to last dynode is shown in phantom in FIG. 2 and its side member and lead 44 are shown. Similar arrangement is used for the other dynodes mounted between the side supports, and their leads.

Figure 3:
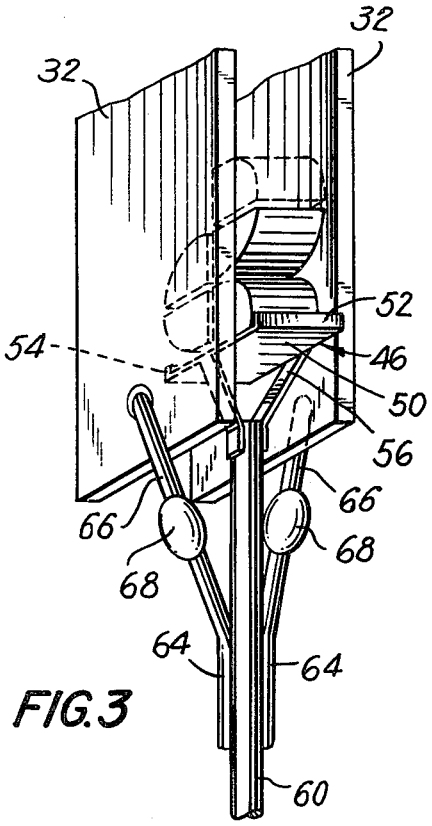
FIG. 3 is a perspective view similar to FIG. 2, but showing the anode of the invention.

It has been found that the electrical properties of the tube can be improved by changing the anode structure from that shown in FIG. 2 to that shown in FIG. 3. For example, the dark current and hysteresis are reduced and signal to noise ratio are improved. It is believed that some of the dark current in the tube of FIG. 2 is due to ohmic leakage or current leakage across the supporting insulator 32. It is to be appreciated that there is a large potential difference between the grid 20 and first of the dynodes and the anode. High quality insulator material used for the support 32 will held remedy the source of leakage but there is usually some alkaline metal, e.g., cesium vapor in the tube from the photocathode, which may condense on the support 32 and form a conduction path. In small size tubes the matter is acute as it is difficult to have the high voltage elements, e.g., the anode, in the tube spaced far enough away from the low voltage element, e.g., the first dynode. Sometimes the ohmic leakage currents are steady and then their contribution to noise is small. However, as the result of the instability of the thin films of cesium and other alkaline metals, it is possible to get fluctuations in ohmic leakage to the anode which will show up as noise.

FIG. 3 shows an anode constructed in accordance with an embodiment of the invention. Here the anode 46 has the same basic shape — flat bottom 50 and front and rear lips 52 and 54. The side members 56 do not extend to nor touch the side support 32, but extend downward in FIG. 3 toward the stem and are attached to a wire 60 which is mounted and supported by the stem (it preferably is connected to a conducting pin (such as 28 in FIG. 1) which is in turn mounted in the stem). The wire 60 provides a mechanical support, and an electrical conducting path for the anode. Thus, in FIG. 3 the anode is no longer directly, and electrically, connected to the side supports 32 which support the dynode. Thus, a major source of ohmic leakage is reduced.

Figure 4:
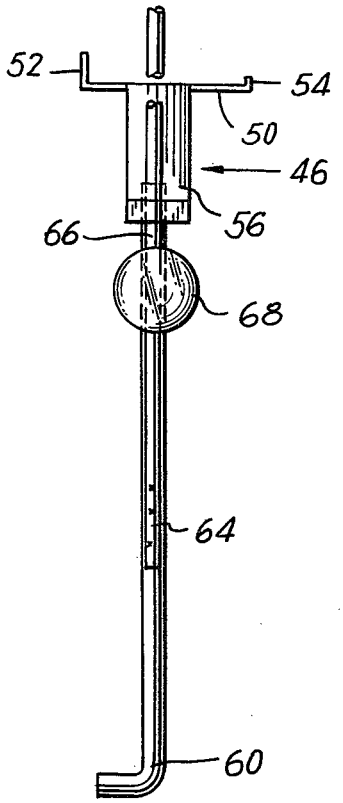
FIG. 4 is a plane side view of the anode structure separate from the tube.
Figure 5:
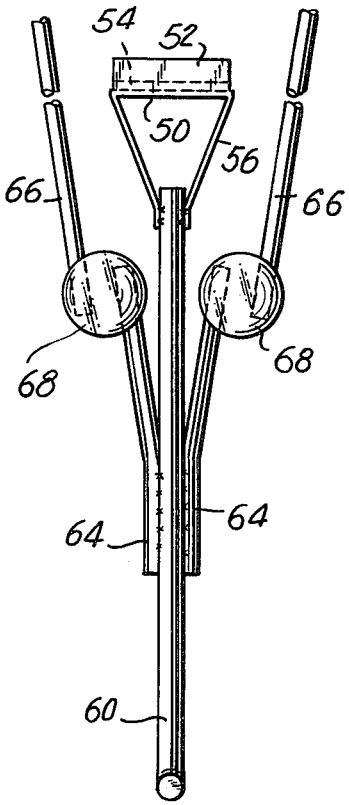
FIG. 5 is a plane front view of the anode structure of FIG. 4.

As shown in FIGS. 3, 4 and 5, a pair of support rod assemblies 64, 66, 68 extend from the sides of the wire 60 to the side supports 32. In FIGS. 4 and 5 the floating anode assembly is shown by itself, e.g., not in relation to the side support.

The support rod assemblies include a pair of lower members 64 whose lower portions are welded to the middle of wire 60 and whose upper portions are bent outward and away from wire 60. There is a pair of upper members 66 which are joined to the lower members by glass beads 68. The properties of the members 64 and 66 are their resiliency and mechanical strength and are typically kovar wire of 30 mil (mil = 1/1000 inch) diameter. The important property of the glass beads 68 is that they be electrically insulating. The structure 64, 66, 68 could be replaced, by any member which would have proper mechanical properties (rigidity) for positioning the anode 46 relative to the side supports 32, and electrical properties to minimize any conducting path between the side support and the anode. The upper members 66 at their ends are mechanically anchored to the side support 32. In practice, because of the small space available on the side supports for an anchor, the upper ends of the members 66 are anchored to the nearest available positions, e.g. the leftmost, shown in FIG. 3, support 66 is anchored to the left anchor position of dynode 10, while the right (hidden in the view) is anchored to the right side anchor position of dynode 10; thus the upper ends of the members 66 are at the same potential as the tenth dynode, but the beads 68 are electrically insulating. The beads 68 also inhibit the flow of leakage currents from the support 32.

It will be noted further that the floating aode structure is remote from the photocathode, which is believed to be the source of the alkaline metal contaminants which produce leakage currents. Thus, condensation is less apt to occur towards the stem end of the tube and on the anode structure.

It is also believed that the glass bead 68 has a tendency to produce less condensation than the ceramic.

It is possible to construct a tube with the floating anode without the support rod assembly 64, 66 and 68. However, this is done at the risk of introducing microphonics, i.e., if the tube is mechanically moved (accelerated or decelerated) the anode may move slightly. Such movement of the anode relative to the last dynode changes the electric field between the dynode and the anode which causes a distortion in the current. Thus, to reggedize the anode it is desirably to use the support rod assembly.

In a $\frac{3}{4}$ inch tube the rod 60 may be $\frac{7}{8}$ inch long of 40 mil stainless steel, and attached at its lower end to a pin mounted in the stem. The members 64 and 66 are kovar 30 mil diameter.

Various modifications can be made in the details without departing from the spirit and scope of the invention.

I claim:

1. A photomultiplier tube comprising a photocathode, a plurality of dynodes rigidly supported in fixed spatial relation to one another on a first support member, an anode being located adjacent to a last one of said dynodes, said anode being supported by a second support member which is separate from first support member, said first support member is a pair of dielectric side supports between and to which said dynodes are rigidly mounted, electrical contacts and leads to said dynodes extend outside said pair of side supports, said first support member is rigidly attached to the inside of a glass envelope which houses said tube, said second support member is a wire which is attached to a different portion of said tube, said wire is electrically conducting and is rigidly attached to a pin in a stem of the envelope and a pair of members extending between said first and second support members, said pair of members being electrically insulating and mechanically rigid, and for preventing microphonics between said anode and last dynode.

2. A photomultiplier tube comprising a photocathode, a plurality of dynodes rigidly supported in fixed spatial relation to one another on a first support member, an anode being located adjacent to a last one of said dynodes, said anode being supported by a second support member which is separate from first support member, said first support member is a pair of dielectric side supports between and to which said dynodes are rigidly mounted, electrical contacts and leads to said dynodes extend outside said pair of side supports, said first support member is rigidly attached to the inside of a glass envelope which houses said tube, said second support member is a wire which is attached to a different portion of said tube, said wire is electrically conducting and is rigidly attached to a pin in a stem of the envelope, a pair of members extending between said first and second support members, said pair of members being electrically insulating and mechanically rigid, and for preventing microphonics between said anode and last dynode, said pair of members each include a lower and an upper member of resilient conductive material joined to each other by an insulating material, said upper members being anchored at their upper ends to opposite sides of said side supports, and said lower members being joined at their lower ends to a central region of said wire.

3. A photomultiplier tube according to claim 2 wherein at least one of said anchors is an anchor which is also electrically connected to one of said dynodes.

4. A photomultiplier tube according to claim 3 wherein said upper and lower member are kovar and said insulating material is glass.

* * * * *